US006963158B2

(12) United States Patent
McCullough et al.

(10) Patent No.: US 6,963,158 B2
(45) Date of Patent: Nov. 8, 2005

(54) MOUNT ASSEMBLY FOR DISCHARGE LAMPS

(75) Inventors: Ebon L. McCullough, New Ipswich, NH (US); Glen P. Williamson, Manchester, NH (US)

(73) Assignee: Osram Sylvania Inc., Danvers, MA (US)

( * ) Notice: Subject to any disclaimer, the term of this patent is extended or adjusted under 35 U.S.C. 154(b) by 251 days.

(21) Appl. No.: 10/641,723

(22) Filed: Aug. 15, 2003

(65) Prior Publication Data

US 2005/0035698 A1 Feb. 17, 2005

(51) Int. Cl.[7] ..... H01J 1/88; H01J 19/42

(52) U.S. Cl. ..... 313/25; 313/17; 313/238; 313/324

(58) Field of Search ..... 313/17, 25, 238, 313/324

(56) References Cited

U.S. PATENT DOCUMENTS 3,218,495 A * 11/1965 Hasell et al. ..... 313/25
6,153,968 A * 11/2000 Dombrowski et al. ..... 313/238
6,291,933 B1 * 9/2001 Dombrowski et al. ..... 313/25
6,326,721 B1 * 12/2001 Shippee et al. ..... 313/283

* cited by examiner

*Primary Examiner*—Mariceli Santiago
(74) *Attorney, Agent, or Firm*—William E. Meyer

(57) ABSTRACT

A mount assembly (10) for an arc discharge vessel has a glass stem (12) having a longitudinal axis (14) that includes a flare (16) with a barrel portion (18) and a seal portion (20) containing at least two relatively rigid stem-leads, (22 and 24), projecting therefrom A relatively rigid wire frame (26) is provided with the frame (26) having a distal end (28) and a proximal end (30). A loop portion (32) is formed at the proximal end (30) and has a diameter substantially equal to the diameter of the barrel (18) and is affixed thereto. The distal end (28) of the wire frame (26) extends away from the barrel portion in a direction transverse to the plane of the loop portion (32). An arc discharge vessel (34, 34*a*), having a substantially linear configuration and having electrode connections (36) and (38) extending from the ends thereof is positioned on the longitudinal axis (14) and is affixed to the wire frame. A first of the stem-leads, for example, (22), is fixedly attached to the wire frame (26) near the proximal end (30) and a first of the electrode connections, for example, (36), is affixed to the stem-lead (24). The second the electrode connection (38) is affixed to the wire frame (26) at the distal end (28).

4 Claims, 1 Drawing Sheet

MOUNT ASSEMBLY FOR DISCHARGE LAMPS

TECHNICAL FIELD

This invention relates to lamps and more particularly to mount assemblies for arc discharge lamps. Still more particularly it relates to mount assemblies that are economical to fabricate, suitable for automation, mounted to low-wattage lamps and useable with two distinct kinds of lamps.

BACKGROUND ART

Mount assemblies for arc discharge lamps usually employ a discharge vessel mounted upon a frame. The frame is generally mounted by means of clips to the flare. The flare itself comprises a tubular body that can carry the exhaust tubulation and seals the in-leads in a pinch seal. Previous assemblies have employed formed, soft nickel straps that were welded to one leg of a frame, curled manually, welded to a second leg of the frame, placed around the barrel portion of the flare, grasped with pliers and welded together. Further forming conformed the strap to the profile of the flare barrel. Such assemblies are expensive and require a great deal of manual operations to complete. The repetitious hand operations also had unacceptable ergonomic issues.

Additionally, it has been necessary to provide different, individual mount assemblies for carrying different types of arc tubes.

DISCLOSURE OF INVENTION

It is, therefore, an object of the invention to obviate the disadvantages of the prior art.

It is another object of the invention to enhance mount structures for arc discharge vessels.

Yet another object of the invention is the provision of a mount structure that, with little modification, can be employed with very different arc discharge vessels.

These object are accomplished, in one aspect of the invention, by the provision of a mount assembly for an arc discharge vessel that comprises a glass stem having a longitudinal axis that includes a flare with a barrel portion and a seal portion containing at least two relatively rigid stem-leads projecting therefrom. A relatively rigid wire frame is provided with the frame having a distal end and a proximal end.

A loop portion is formed at the proximal end and is affixed to the barrel portion of the flare and the distal end extends away from the barrel portion in a direction transverse to the plane of the loop portion. An arc discharge vessel having a substantially linear configuration and having an electrode connection extending from each end positioned on said longitudinal axis is associated with the wire frame. A first of the stem-leads is fixedly attached to the wire frame near the proximal end and a first of the electrode connections is affixed to another of the stem-leads. A second of the electrode connections is affixed to the wire frame at the distal end.

This structure provides a rigid mount capable of sustaining the proper orientation of the arc discharge vessel even when the lamp with which it is employed is mounted in a horizontal attitude. Additionally, the simple wire frame is easily adaptable to mount both sodium arc tubes, which generally are long and slim and the new metal halide arc discharge vessels, which are short, bulgy, and usually mounted within a shield.

BEST MODE FOR CARRYING OUT THE INVENTION

For a better understanding of the present invention, together with other and further objects, advantages and capabilities thereof reference is made to the following disclosure and appended claims in conjunction with the above-described drawings.

Figure 1:
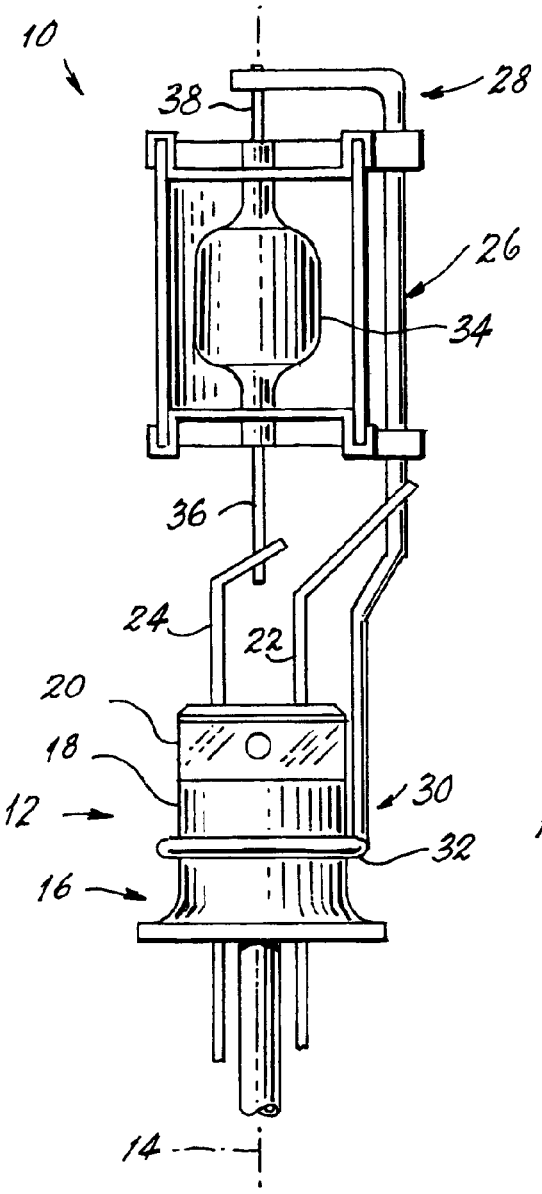
FIG. 1 is a diagrammatic elevational view of an embodiment of the invention used with an short, bulgy arc discharge vessel.

Referring now to the drawings with greater particularity, there is shown in FIG. 1. a mount assembly 10 for an arc discharge vessel that comprises a glass stem 12 having a longitudinal axis 14 that includes a flare 16 with a barrel portion 18 and a seal portion 20 containing at least two relatively rigid stem-leads, 22 and 24, projecting therefrom. A relatively rigid wire frame 26 is provided with the frame 26 having a distal end 28 and a proximal end 30. As used herein the term relatively rigid as applied to the stem-leads means a stem-lead having a diameter of about 0.050 inches and as applied to the wire frame means a wire diameter of about 0.060 to 0.080 inches.

A loop portion 32 is formed at the proximal end 30 and has a diameter substantially equal to the diameter of the barrel 18 and is affixed thereto. The distal end 28 of the wire frame 26 extends away from the barrel portion in a direction transverse to the plane of the loop portion 32. An arc discharge vessel 34, in this instance a bulgy arc tube having a substantially linear configuration and having electrode connections 36 and 38 extending from the ends thereof and surrounded by a shield 40, is positioned on the longitudinal axis 14 and is affixed to the wire frame. As shown, the arc tube 34 is mounted within the shield 40 by straps 42 and 44 it is tabs 46 and 48 that are attached to the wire frame 26, preferably by welding. A first of the stem-leads, for example, 22, is fixedly attached to the wire frame 26 near the proximal end 30 and a first of the electrode connections, for example, 36, is affixed to the stem-lead 24. The second the electrode connection 38 is affixed to the wire frame 26 at the distal end 28.

As shown in FIG. 1 the distal end 28 can be formed at a right angle to the main body of the wire frame 26 to aid in fixing the electrode connector 38.

Figure 2:
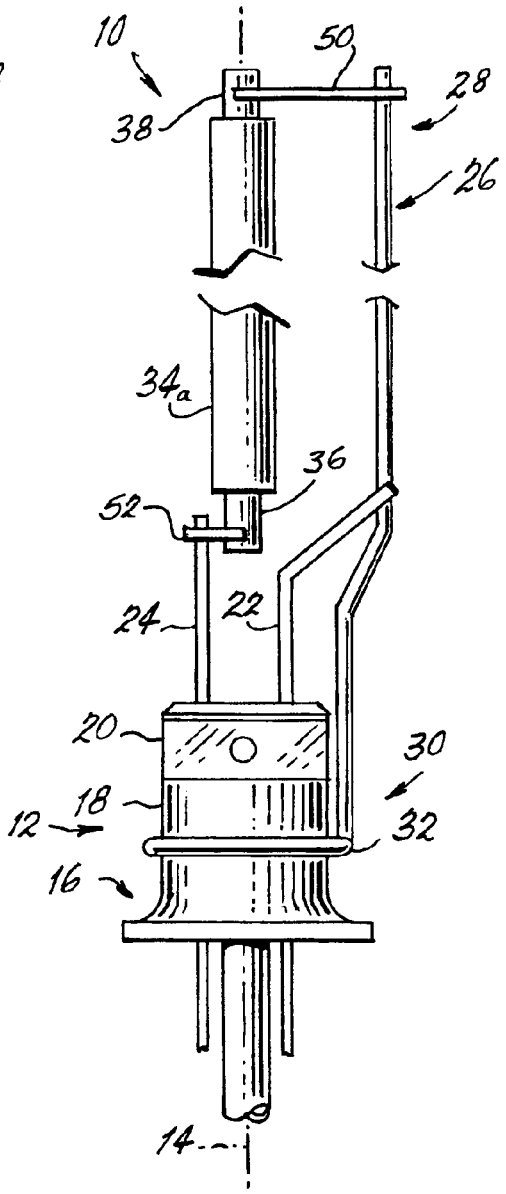
FIG. 2 is a similar view of an embodiment of the invention used with a long, slim arc discharge vessel.

In a second embodiment shown in FIG. 2, the arc discharge tube 34*a* provides a sodium discharge and, as is well known in the art, comprises a slim, elongated polycrystalline arc tube. In this embodiment additional electrical contacts 50, 52 can be used to make the electrical connection between the stem-lead 36 and the distal end 28 of the wire frame 26.

This structure provides a rigid mount capable of sustaining the proper orientation of the arc discharge vessel even when the lamp with which it is employed is mounted in a horizontal attitude. Additionally, the simple wire frame is easily adaptable to mount both sodium arc tubes, which generally are long and slim and the new metal halide arc discharge vessels, which are short, bulgy, and usually mounted within a shield.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A mount assembly for an arc discharge vessel comprising:

a glass stem having a longitudinal axis and including a flare having a barrel portion and a seal portion containing at least two relatively rigid stem-leads projecting therefrom:

a relatively rigid wire frame having a distal end and a proximal end;

a loop portion at said proximal end affixed to said barrel portion, said distal end extending away from said barrel portion in a direction transverse to the plane of said loop portion: and an arc discharge vessel having a substantially linear configuration and having an electrode connection extending from each end positioned on said longitudinal axis, a first of said stem-leads being fixedly attached to said wire frame at said proximal end, a first of said electrode connections being affixed to another of said stem-leads, and a second of said electrode connections being affixed to said wire frame at said distal end.

2. The mount assembly of claim 1 wherein said arc discharge vessel comprises an elongated arc tube.

3. The mount assembly of claim 1 wherein said arc discharge vessel comprises a bulgy arc tube surrounded by a light transmitting shield.

4. The mount assembly of claim 3 wherein said bulgy arc tube is mounted within said shield by a strap at either end of the shield and said straps are affixed to said wire frame.

* * * * *